US010808478B2

(12) United States Patent
Goodell et al.

(10) Patent No.: US 10,808,478 B2
(45) Date of Patent: Oct. 20, 2020

(54) ASSEMBLY AND METHOD FOR PERFORMING ALIGNED OPERATION WITH TOOL ORIENTED IN DOWNHOLE TUBULAR

(71) Applicant: Weatherford Technology Holdings, LLC, Houston, TX (US)

(72) Inventors: Eric W. Goodell, Houston, TX (US); Winfield M. Sides, Bellaire, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 340 days.

(21) Appl. No.: 15/896,585

(22) Filed: Feb. 14, 2018

(65) Prior Publication Data

US 2019/0249506 A1 Aug. 15, 2019

(51) Int. Cl.

| | |
|---|---|
| ***E21B 23/01*** | (2006.01) |
| ***E21B 23/02*** | (2006.01) |
| ***E21B 34/10*** | (2006.01) |
| ***E21B 23/00*** | (2006.01) |

(52) U.S. Cl.

CPC ..... *E21B 23/01* (2013.01); *E21B 23/006* (2013.01); *E21B 23/02* (2013.01); *E21B 34/106* (2013.01)

(58) Field of Classification Search

CPC ..... E21B 23/00; E21B 23/004; E21B 23/006; E21B 23/01

See application file for complete search history.

(56) References Cited

U.S. PATENT DOCUMENTS

| | | | | |
|---|---|---|---|---|
| 5,249,630 | A | 10/1993 | Meaders et al. | |
| 5,735,350 | A | 4/1998 | Longbottom et al. | |
| 6,012,527 | A * | 1/2000 | Nitis | E21B 7/061 166/313 |
| 6,202,746 | B1 | 3/2001 | Vandenberg et al. | |
| 6,523,614 | B2 | 2/2003 | Dennistoun et al. | |
| 7,249,635 | B2 | 7/2007 | Dennistoun et al. | |
| 7,918,280 | B2 | 4/2011 | Mailand et al. | |
| 2012/0305269 | A1 * | 12/2012 | Bories | E21B 33/0415 166/382 |
| 2014/0144619 | A1 * | 5/2014 | O'Brien | E21B 23/02 166/237 |

FOREIGN PATENT DOCUMENTS

WO 2014084823 A1 6/2014

OTHER PUBLICATIONS

Int'l Search Report & Written Opinion received in copending PCT Application No. PCT/US2019/014251 dated Apr. 10, 2019, 13 pages.

* cited by examiner

*Primary Examiner* — Tara Schimpf
(74) *Attorney, Agent, or Firm* — Blank Rome, LLP

(57) ABSTRACT

To perform an aligned operation downhole, a tubular disposed downhole has an internal bore with a first inner circumference and has a target at a first radial orientation. A locator profile is defined about the internal bore at a first location, and an internal nipple is defined about the internal bore at a second location. The internal nipple has a second inner circumference less than the first of the internal bore. An orientation slot is defined longitudinally across the internal nipple and is disposed at a second radial orientation configured relative to the first radial orientation of the target. A tool is deployable into the internal bore. The tool has a locator to engage in the locator profile and has an orientation key to engage in the slot and align an operational component for the aligned operation with the target.

28 Claims, 8 Drawing Sheets

ASSEMBLY AND METHOD FOR PERFORMING ALIGNED OPERATION WITH TOOL ORIENTED IN DOWNHOLE TUBULAR

BACKGROUND OF THE DISCLOSURE

Downhole tools often need to rotate to orient to a certain clock position for a task to be performed. For example, a mule shoe sleeve can be included in a downhole component to help orient an operational tool at a later time. The mule shoe sleeve has an open-ended triangular slot for orienting the operational tool. In one use, the operational tool is passed downhole of the mule shoe sleeve. A finger on the tool springs out. Then, upon upward motion of the tool, the finger engages in the mule shoe's open-ended triangular slot to orient the tool to the desired position.

A punching tool is one such operational tool that needs to be oriented downhole to perform a punching operation. For example, a tubing retrievable safety valve disposed downhole in the wellbore may have failed, or the hydraulic communication to the valve may have been disrupted. The punching tool can then be used to punch a new communication path with a hydraulic port in the safety valve.

What is needed is a way to orient an operational tool, such as a punching tool, in a downhole component without the need to initially include a mule shoe sleeve in the assembly run downhole. The subject matter of the present disclosure is directed to overcoming, or at least reducing the effects of, one or more of the problems set forth above.

SUMMARY OF THE DISCLOSURE

An assembly according to the present disclosure for performing an aligned operation downhole comprises a tubular and a tool. The tubular for downhole defines an internal bore with a first inner radius, and the tubular has a target at a first radial orientation. The internal bore defines a locator profile thereabout at a first location and defines an internal nipple thereabout at a second location. The internal nipple has a second inner radius less than the first inner radius of the internal bore. An orientation slots is at least partially defined longitudinally through the internal nipple. This slot is disposed at a second radial orientation configured relative to the first radial orientation of the target.

The tool is deployable in a longitudinal direction into the internal bore of the tubular and has first and second portions. The first portion has a locator biased outward to engage in the locator profile of the tubular. The second portion is rotatable relative to the first portion and has an operational component to perform the aligned operation at the first radial orientation of the target. The second portion has an orientor, such as a pin or key, biased outward to engage in the orientation slot of the tubular so that the operational component can be aligned for the aligned operation at the first radial orientation with the target.

The tubular can comprise a plurality of tubular components coupled together. For example, a first of the tubular components can define the locator profile therein, and a second of the tubular components can define the orientation slot and can comprise the target at the first radial orientation. In one particular example, one of the tubular components can comprise a safety valve housing defining the orientation slot. The safety valve housing can have a hydraulic passage therein as the target at the first radial orientation.

The internal nipple and the orientation slot can include a number of variations. The second inner radius of the internal nipple can define a taper adjacent the orientation slot increasing a lead-in of the second inner radius in a radial direction inward toward the orientation slot. The orientation slot can include a channel defined through the nipple and can have a face inset at a depth into the internal nipple. The face can have a lead sidewall on a lead edge in the radial direction and can have a back sidewall on a back edge in the radial direction. The back sidewall can define an acute angle relative to the face.

In one arrangement, the channel comprises an open end disposed at a downhole edge of the internal nipple. In another arrangement, the channel can include open ends disposed at both uphole and downhole edges of the internal nipple.

The tool can comprises a rotational drive disposed between the first and second portions of the tool that imparts rotational movement to the second portion in a rotational direction in the internal bore. The orientation key is rotatable with the second portion and is biased outward to engage in the orientation slot. The second portion with the orientation key engaged in the orientation slot can then align the operational component for the aligned operation at the first radial orientation of the target.

The locator can comprise a plurality of keys disposed on the first portion and biased outward from a retracted condition to an extended condition.

A number of rotational drives can be used. In one example, the rotational drive comprises a sleeve and an inner rod. The sleeve is movable in the longitudinal direction in a housing of the first portion and has at least one external tooth and at least one internal tooth. The at least one external tooth is engaged with at least one spiral groove defined in the housing. The inner rod is coupled to the second portion and has at least one longitudinal spline engaged with the at least one internal tooth of the sleeve. The inner rod is rotatable with the sleeve in the radial direction about the longitudinal axis.

In another example, the rotational drive again comprises a sleeve and an inner rod. The sleeve is movable in the longitudinal direction in a housing of the first portion and has at least one external spiral groove and at least one internal tooth. The at least one external spiral groove is engaged with at least one tooth in the housing. The inner rod coupled to the second portion has at least one longitudinal spline engaged with the at least one internal tooth of the sleeve. The inner rod is rotatable with the sleeve in the radial direction about the longitudinal axis.

In yet another example, wherein the rotational drive comprises an inner rod and a spring. The inner rod is coupled to the second portion, and the spring is coupled between the first portion and the inner rod. The spring, which is held in torsion, rotates the inner rod in the radial direction about the longitudinal axis.

The orientation key can comprise a fin extending longitudinally along the second portion and biased laterally outward from a retracted condition to an extended condition. The second portion can comprise an internal member having a carriage disposed externally thereon. The carriage is biased toward a retracted state on the internal member, and the carriage has the orientation key, which is disposed thereon and is biased toward an extended condition. The internal member is movable longitudinally relative to the carriage and forces the carriage in an extended state into contact with the internal bore of the tubular.

An assembly according to the present disclosure for performing an aligned operation downhole comprises a tubular for downhole defining an internal bore with a first inner radius, the tubular having a target at a first radial orientation. A locator profile is defined about the internal bore at a first location, and an internal nipple is defined about the internal bore at a second location. The internal nipple having a second inner radius less than the first inner radius of the internal bore. An orientation slot is at least partially defined longitudinally through the internal nipple and is disposed at a second radial orientation configured relative to the first radial orientation of the target.

The assembly may further comprises a tool deployable in a longitudinal direction into the internal bore and having first and second portions. The second portion is rotatable relative to the first portion and has an operational component to perform the aligned operation at the first radial orientation of the target.

A locator is disposed on the first portion of the tool and is biased outward to engage in the locator profile of the tubular. A rotational drive disposed between the first and second portions of the tool imparts rotational movement to the second portion in a rotational direction in the internal bore. An orientation key disposed on the second portion of the tool is rotatable with the second portion and is biased outward to engage in the orientation slot. The second portion with the orientation key engaged in the orientation slot aligns the operational component for the aligned operation at the first radial orientation of the target.

A method according to the present disclosure performs an aligned operation downhole. The method comprising: arranging a locator profile at a first location in an internal bore of a tubular; arranging an orientation slot at a second location in the internal bore of the tubular by at least partially defining the orientation slot longitudinally through an internal nipple having a second inner radius in the internal bore less than a first inner radius of the internal bore; deploying the tubular downhole; deploying a tool in a longitudinal direction into the internal bore of the deployed tubular; locating a locator biased outward on a first portion of the tool in the locator profile; rotating an orientation key biased outward on a second portion of the tool; and aligning an operational component for the aligned operation on the second portion of the tool by engaging the orientation key in the orientation slot of the tubular.

Arranging the orientation slot can further comprise defining a taper in the second inner circumference of the internal nipple adjacent the orientation slot increasing a lead-in of the second inner radius in a rotational direction inward toward the orientation slot. Arranging the orientation slot can further comprise arranging the orientation slot as a channel having a face inset at a depth into the internal nipple, the face having a lead sidewall on a lead edge in a rotational direction and having a back sidewall on a back edge in the rotational direction, the back sidewall defining an acute angle relative to the face. Arranging the orientation slot can further comprise arranging the orientation slot with open ends on first and second edges of the internal nipple.

Locating the locator biased outward on the tool in the locator profile can comprise engaging a plurality of keys disposed on the first portion of the tool and biased outward from a retracted condition to an extended condition in the locator profile.

Rotating the orientation key biased outward on the second portion of the tool can comprise imparting rotational movement of the second portion of the tool in a rotational direction in the internal bore by actuating a rotational drive disposed between the first and second portions of the tool.

For example, actuating the rotational drive disposed between the first and second portions of the tool can comprise: moving a sleeve in the longitudinal direction in a housing of the first portion; running at least one external tooth of the sleeve engaged in at least one spiral groove defined in the housing; and rotating an inner rod coupled to the second portion by running at least one internal tooth of the sleeve engaged in at least one longitudinal spline of the inner rod.

In another example, actuating the rotational drive disposed between the first and second portions of the tool can comprise: moving a sleeve in the longitudinal direction in a housing of the first portion; running at least one external spiral groove of the sleeve engaged by at least one tooth in the housing; and rotating an inner rod coupled to the second portion by running at least one internal tooth of the sleeve engaged in at least one longitudinal spline of the inner rod.

In yet another example, actuating the rotational drive disposed between the first and second portions of the tool can comprise: releasing a spring held in torsion; and rotating an inner rod coupled to the second portion with the released spring.

Meanwhile, engaging the orientation key in the orientation slot of the tubular component can comprise biasing a fin extending longitudinally along the second portion laterally outward from a retracted condition to an extended condition.

The foregoing summary is not intended to summarize each potential embodiment or every aspect of the present disclosure.

DETAILED DESCRIPTION OF THE DISCLOSURE

Figure 1A:
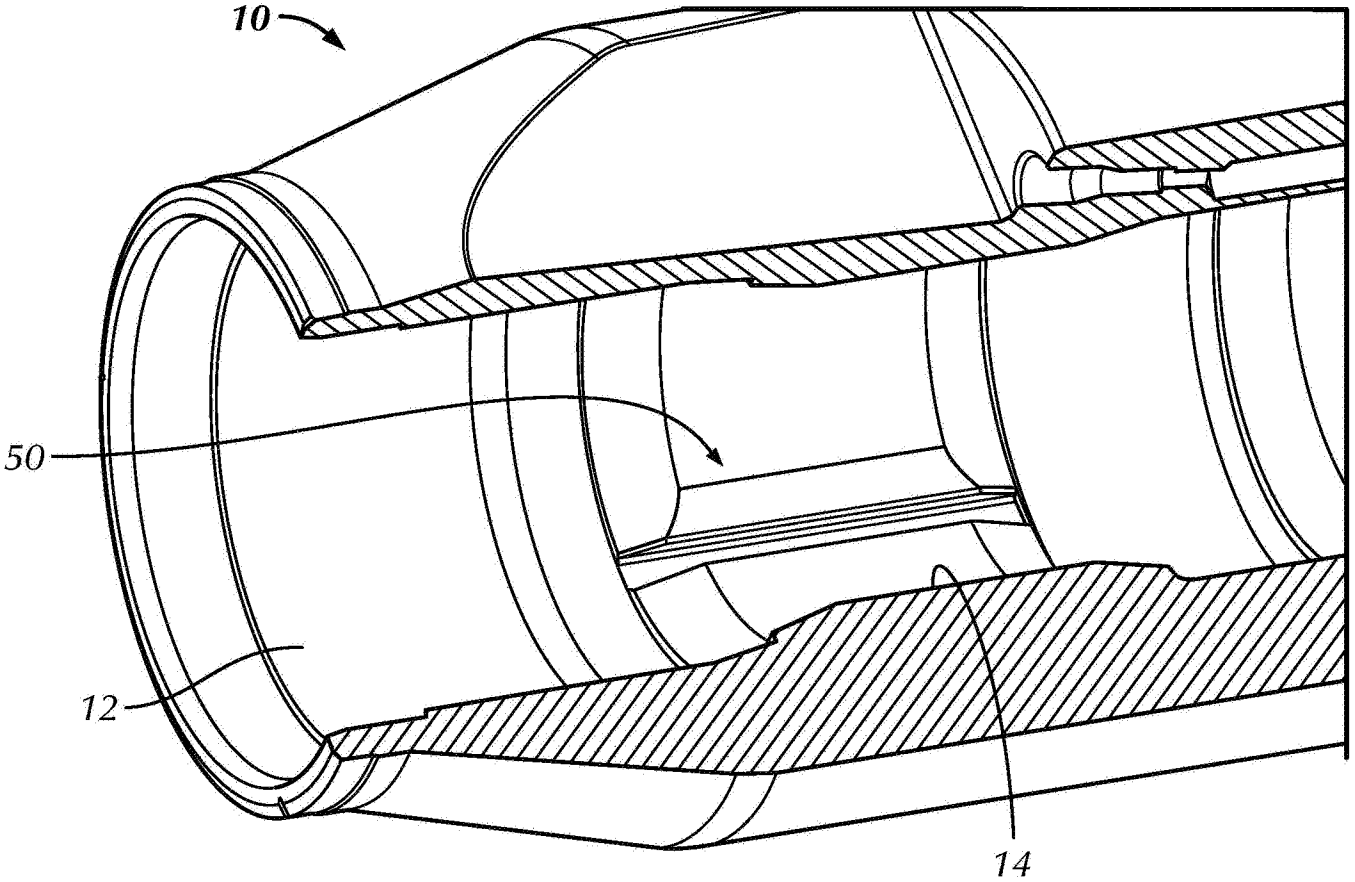
FIGS. 1A-1B illustrate cutaway views of a tubular having an orientation slot defined therein.
Figure 1B:
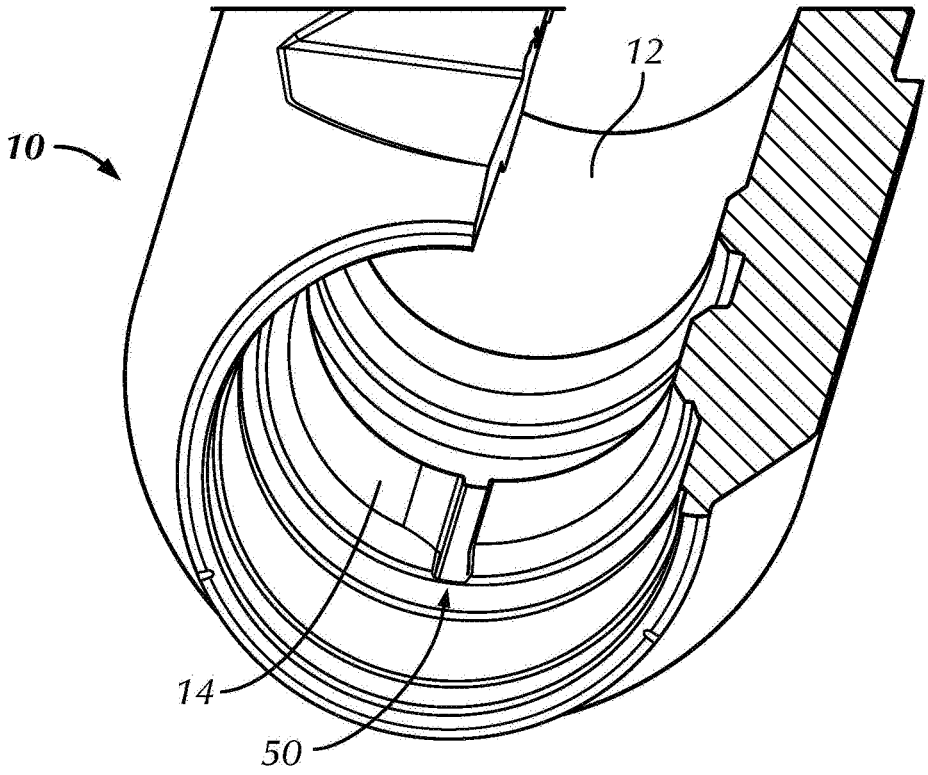
Figure 1C:
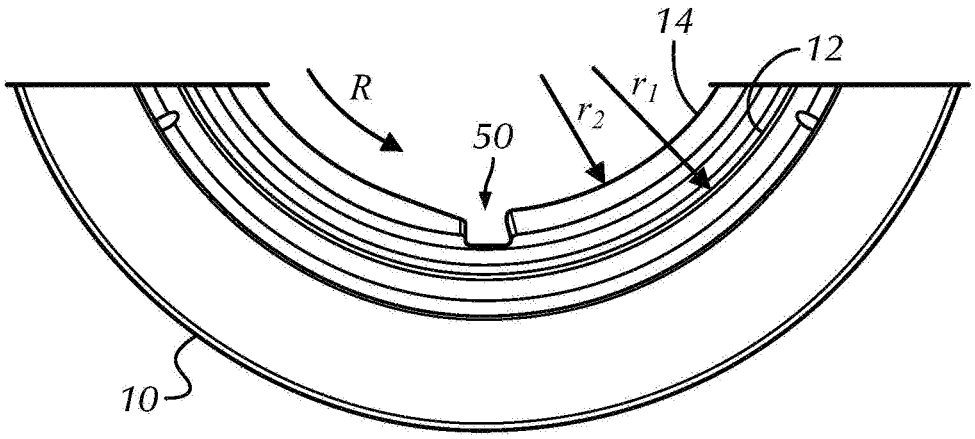
FIGS. 1C-1D illustrate end views of the tubular having the orientation slot defined therein.
Figure 1D:
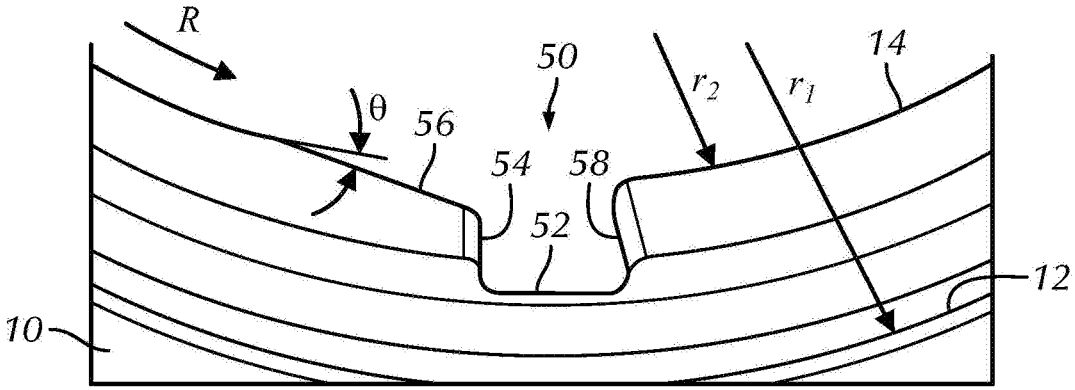

FIGS. 1A-1B illustrate cutaway views of a portion of a tubular 10 having an orientation slot 50 defined therein, and FIGS. 1C-1D illustrate end views of the tubular 10 having the orientation slot 50 defined therein. In general, the tubular 10 can be a housing or other component used downhole on tubing in a well. For example, the tubular 10 can be part of a housing of a downhole tool, such as a safety valve. Likewise, the tubular 10 can include a plurality of tubular components coupled together.

The orientation slot 50 is defined inside the tubular 10 for orienting an operational tool (not shown) to perform a desired task inside the tubular 10 or in some other section of a downhole tubular. As opposed to the need to incorporate a mule shoe style orientation sleeve into a tubular housing as required in the prior art, the orientation slot 50 can be integrated directly into the tubular 10 for use downhole in orienting the operational tool.

The orientation slot 50 is formed in the sidewall of the tubular's internal bore 12 and is formed at an internal restriction or nipple 14 of the bore 12. The internal nipple 14 has a second inner radius r2 less than a first inner radius r1 of the internal bore 12, and the orientation slot 50 is defined longitudinally across and through the nipple 14.

As best shown in FIGS. 1A-1B, the orientation slot 50 is defined as a longitudinal channel in the internal nipple 14 and preferably has at least one open end on one of the uphole/downhole edges of the nipple 14. In general, the orientation slot 50 does not strictly require an open end. The slot 50 can be open at one or both ends, closed at one or both ends, tapered at one or both ends, or any combination of these. As shown in FIG. 1B, for example, both ends of the slot 50 can be open in the nipple 14, which can help flush the slot 50 clean of debris, can protect passing seal stacks, and can avoid catching any shoulders of various tools that may be passed in either direction.

As best shown in FIGS. 1C-1D, the second inner radius r2 of the internal nipple 14 defines a taper 56 adjacent the orientation slot 50. The taper 56 increases at a lead-in angle θ of the second inner radius r2 in a rotational direction R inward toward the orientation slot 50. As noted below, the lead-in taper 56 helps an orientation key (not shown) to catch the slot's edge 58.

As best shown in FIGS. 1C-1D, the channel of the orientation slot 50 has a face 52 inset at a depth into the internal nipple 14. The face 52 has a lead-in sidewall 54 on a lead-in edge in the rotational direction R and has a back sidewall 58 on a back edge in the rotational direction R. As shown, the back sidewall 58 can define an acute angle relative to the face 52. This acute back angle in the back sidewall 58 can provide a distinct stopping point for engagement with the orientation key (not shown) despite the presence of possible grit in the orientation slot 50.

Preferably, the orientation slot 50 has smooth radial edges to protect any passing seal stacks of operational components installed through the tubular 10. Radii in the transition between the slot's face 52 and sidewalls 54 and 58 can also help to relieve stress points.

Figure 2A:
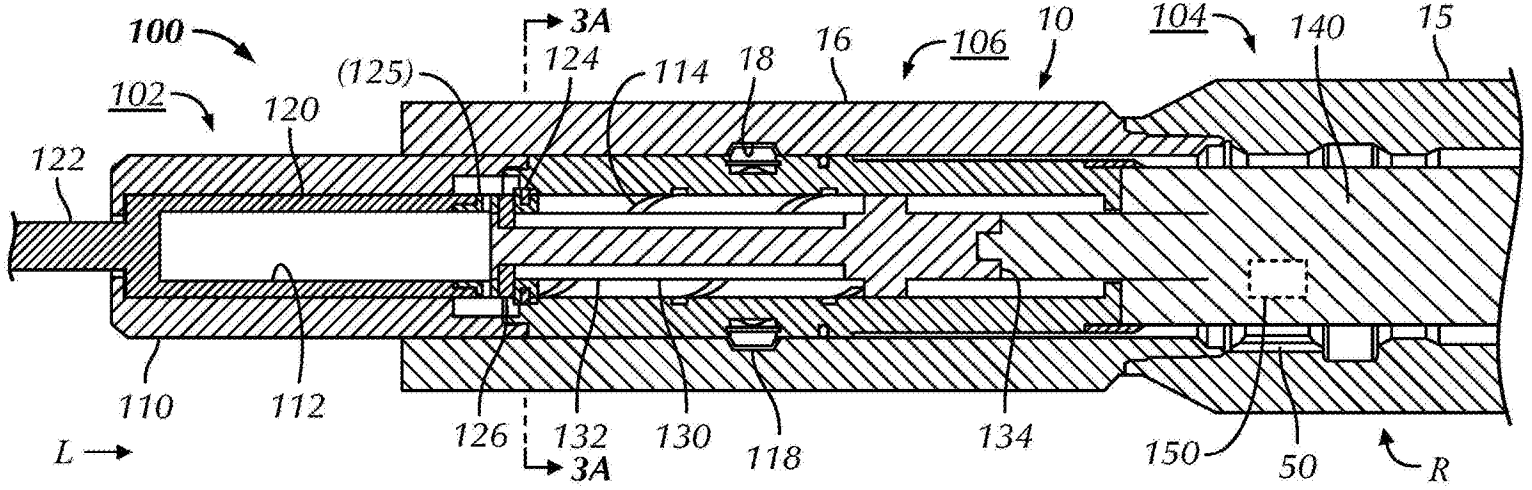
FIGS. 2A-2D illustrate cross-sectional views of an operational tool deployed and oriented in a tubular having an orientation slot defined therein.

As noted above, the tubular 10 is used as part of an assembly for performing an aligned operation downhole. Accordingly, the tubular 10 disposed downhole on tubing is used with a tool deployable in a longitudinal direction into the internal bore 12. Details of one such tool 100 are shown in FIG. 2A. The tool 100 has first and second portions 102, 104. The second portion 104 is rotatable relative to the first portion 102, and the second portion 104 has an operational component 140 to perform an aligned operation either in the tubular 10 itself or elsewhere in the downhole tubing. The operational component 140 can perform some operation, such as electronic communication, punching, milling, etc., requiring alignment between part of the component 140 and a downhole element, such as a transceiver, a hydraulic port, etc.

A locator 118 is disposed on the first portion 102 of the tool 100 and is biased outward to engage in a locator profile 18 of the tubular 10. The locator 118 longitudinally locates the tool 100 in the tubular 10 and is distanced from an orientor 150 disposed on the tool 100 in a comparable manner to how the locator profile 18 is distanced from the orientation slot 50 on the tubular 10.

As depicted here, the tubular 10 may have two or more tubular components or sections connected together—one section 16 having the locator profile 18 and the other section 15 having the orientation slot 50. As will be appreciated, the tubular 10 may be coupled as part of a tubing string run downhole and may be part of a downhole tool's housing, such as of a safety valve. The section 15 of the tubular 10 having the orientation slot 50 may also have a target T at a first radial orientation for the aligned operation, although this target T can be further downhole or part of some other tubular component. The orientation slot 50 is configured at a second radial orientation (e.g., 180-deg) relative to the target T at the first radial orientation (e.g., 0-deg). Other relative orientations are possible.

As shown, the locator 118 can include a plurality of keys disposed on the first portion 102 and biased outward from a retracted condition to an extended condition to engage in the locator profile 18. In general, any suitable type of profile can be used for the locator profile 18. Here, the locator keys 118 are shown in a simplified way. However, the locator keys 118 and profile 18 can use any suitable styles, such as QN style profiles, WX style profiles, etc.

A rotational drive 106 is disposed between the first and second portions 102, 104 of the tool 100 and converts longitudinal movement of the first portion 102 in the longitudinal direction L against the engaged locator keys 118 to rotational movement of the second portion 104 in a rotational direction R in the tubular's internal bore 12.

For its part, the orientor 150 disposed on the second portion 104 of the tool 100 can be a key, a pin, a fin, a finger, or other suitable extendable element used to radially locate the tool's second portion 104 in the tubular 10. In particular, the orientation key 150 is rotatable with the second portion 104 and is biased outward to engage in the orientation slot 50 of the tubular 10 once the key 150 has rotated into alignment with the slot 50. The second portion 104 with the orientation key 150 engaged in the orientation slot 50 can thereby align the operational component 140 for the aligned operation. As such, the orientation slot 50 is suitably located at a position in the tubular 10 relative to where the operations is to be performed.

Figure 3A:
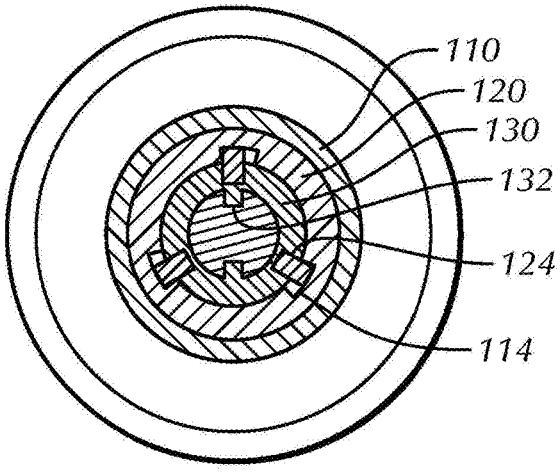
FIGS. 3A-3C illustrate end-sectional views of the operational tool in the tubular.

Various forms of rotational drive 106 can be used. As shown here, the rotational drive 106 includes a sleeve 120 and an inner rod 130. The sleeve 120 is coupled uphole to a running rod 122 and is movable in the longitudinal direction L in a housing 110 of the tool's first portion 102. The sleeve 120 has at least one external tooth 124 and at least one internal tooth 126, which can be disposed on a rotatable bushing or coupling as discussed below. The at least one external tooth 124, which can include a plurality of external shear pins 124 as shown in FIG. 3A, is engaged with at least one spiral groove 114 defined inside the housing 110.

Figure 3B:
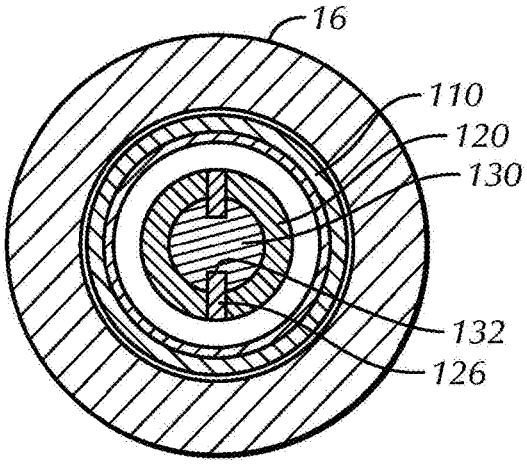

The inner rod 130 is coupled to the tool's second portion 104 with a (fixed) connection 134 to the operational component 140. The inner rod 130 has at least one longitudinal spline 132 engaged with the at least one internal tooth 126 of the sleeve 120. (As shown in FIGS. 3A-3B, for example, the sleeve 120 can have inward shear pins 126 fit into opposing splines 132 defined in the rod 130.)

During actuation as discussed below, the inner rod 130 is rotated in the rotational direction R about the longitudinal axis in response to the longitudinal movement of the sleeve 120. In general, a rotatable bushing or coupling may be provided at some point on the sleeve 120 so that uphole components (not shown), which provide the downhole movement to the sleeve 120, do not need to rotate. For example, the sleeve 120 can include a rotatable coupling or bushing at 125 on which the pins 124 and 126 are disposed. The bushing can rotate inside the housing 110 and can rotate the inner rod 130 while the sleeve 120 does not need to rotate. Other arrangements are possible. For example, a rotatable coupling can be used between the running rod 122 and the uphole components (not shown) that provide the downhole movement to the sleeve 120. Further still, a fixed coupling can be provided at 125 instead of a rotatable bushing or coupling, and the sleeve 120 may be allowed to rotate in the housing 110.

Figure 3C:
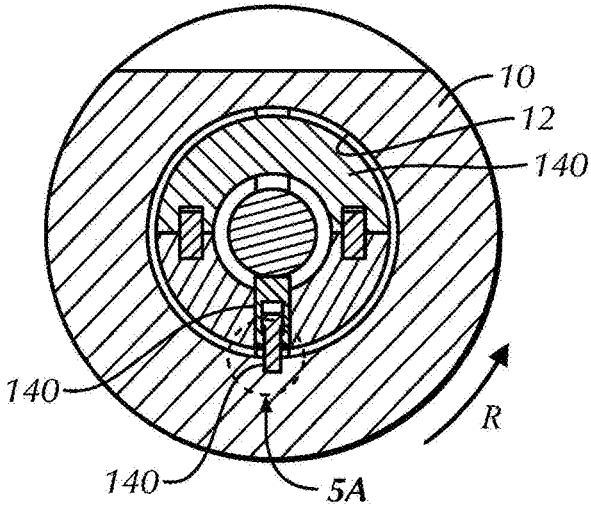

As shown in FIG. 2A, the orientation key 150 can include a fin extending longitudinally along the second portion 104 and biased laterally outward from a retracted condition to an extended condition. As shown in FIG. 3C, for example, a leaf spring 152 or the like can be used to extend the orientation key 150 outward from a pocket in the tool's operational component 140.

In use downhole, the tool 100 is run in hole as shown in FIG. 2A and is passed through the tubular 10 until the biased locator keys 118 engage inside the locator profile 18. The tool 100 can locate in the profile 18, with or without a no-go, to set the depth location so the tool 100 is not inserted further into the tubular 10. The biased locator keys 118 themselves, additional drag blocks, or other feature can keep the housing 110 from rotating inside the tubular 10 during the stages that follow.

Figure 2B:
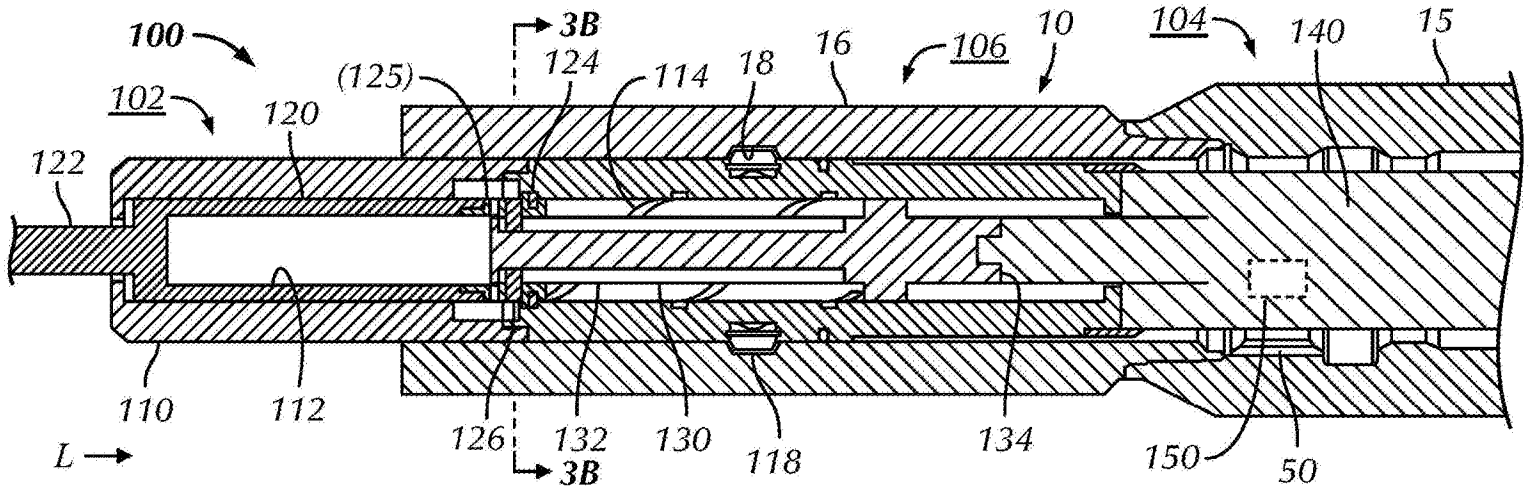

During a top shear stage as shown in FIG. 2B, the internal shaft 122 of the operational tool 100 is jarred downhole to shear top pins 112 inside the operational tool 100 between the sleeve 120 and the inner rod 130. These top pins 112 initially hold the sleeve 120 of the tool 100 to the housing 110 to prevent rotation and movement during run-in. With the top pins 112 sheared, the sleeve 120 can move relative to the housing 110, which remains engaged in the tubular 10 with the locator keys 118.

Figure 2C:
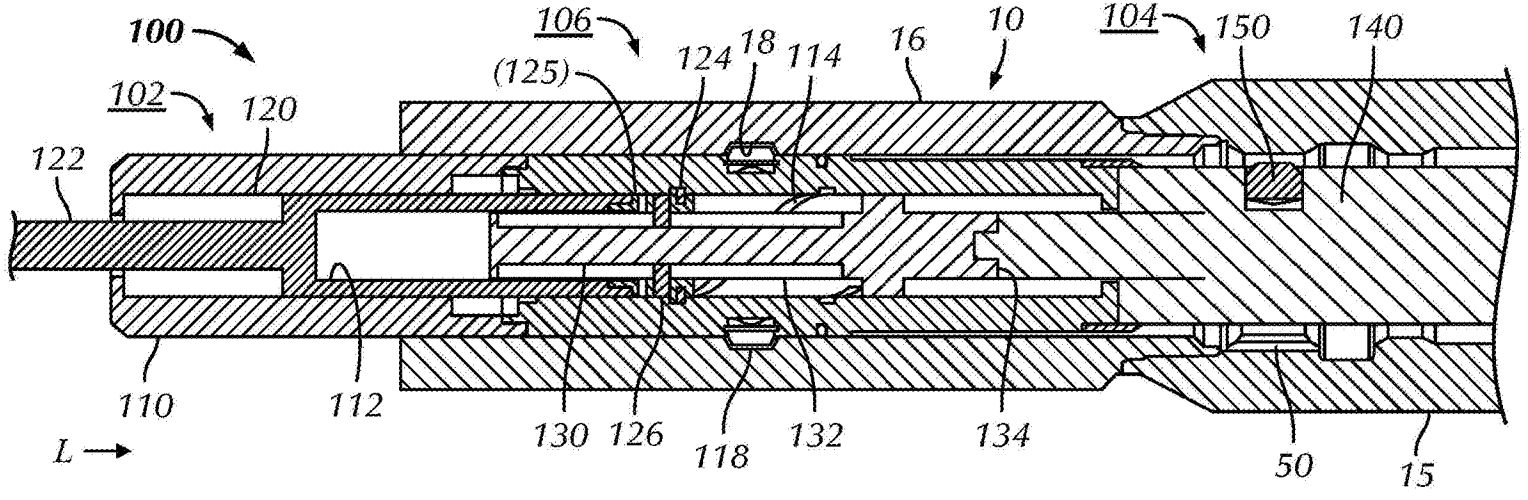

During a rotating stage as shown in FIG. 2C, downhole movement of the running rod 122 causes the operational component 140 to rotate inside the internal bore 12 of the tubular 10 through the rotational drive 106 between the first and second portions 102 and 104 of the tool 100. Rotation occurs until the orientation key 150 rotates and snaps into the orientation slot 50 defined in the downhole tubular 10. The rotational direction R can be counter clockwise, which can tend to tighten threaded connections in the tool 100 as well as the tubing.

In general, the driven rotation can be achieve using internal spline grooves, external spline grooves, a torsion spring, a spring-loaded J-slot or ratchet mechanism, or other mechanism for the rotational drive 106. In the particular configuration of the rotational drive 106 shown here, rotation of the operational component 140 is driven by the external teeth 124 of the sleeve 120 riding in the spiral grooves 114 of the housing 110 and by the internal teeth 126 of the sleeve 120 riding in the spline groove 132 of the inner rod 130 under the weight of the running rod 122. During this process, the sleeve 120 can travel into the housing 110, while the inner rod 130 is turned to rotate the operational component 140 with the coupling 134 inside of the tubular 10.

Figure 2D:
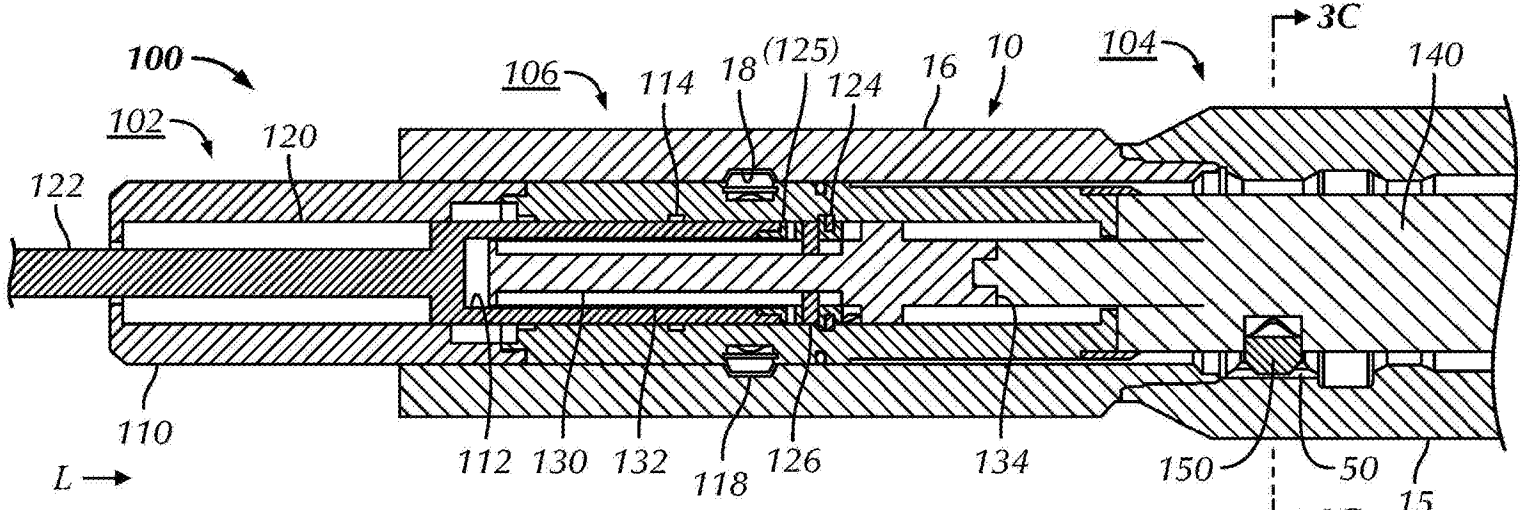

Eventually as shown in FIG. 2D, the operational component 140 rotates so that the orientation key 150 locates in the orientation slot 50 defined in the tubular 10. With the orientation key 150 located in the orientation slot 50, an operational element O of the component 140 can be aligned properly with the tubular's target T so the aligned operation can be performed.

Depending on the operational component 140 used, further actuation may or may not be necessary. In general, the operational component 140 may be operated using electrical, hydraulic, or mechanical activation from the tool 100. In one particular example, the operation component 140 may be operated using downward axial movement applied by the inner rod 130.

In particular, when the orientation key 150 finds the orientation slot 50 as shown in FIG. 2D, the external teeth 124, which can be shear pins on the sleeve 120, are sheared by the downhole movement against them. Accordingly, the sleeve 120 can shift fully inside the housing 110 and can bottom out against the inner rod 130 as shown in FIG. 2D. Then, downward axial movement from the running rod 122 can be transferred directly to the inner rod 130, which may apply that axial movement at the connection 134 to the operation component 140 to actuate some mechanical form of the operation. For example, the operational element O can include a pin that punches into the tubular's inner wall to create a new opening for communicating with a hydraulic port as the target T in the tubular 10, such as used in a hydraulically actuated safety valve.

Pulling out of hole after the operation can involve pulling up on the running rod 122, which moves the sleeve 120 along the inner rod 130 until they shoulder out. Further pulling up on the tool 100 will lift the housing 110 out of the tubular 10 as the locator keys 118 can retract in the uphole direction out of the locator profile 18.

Figure 4A:
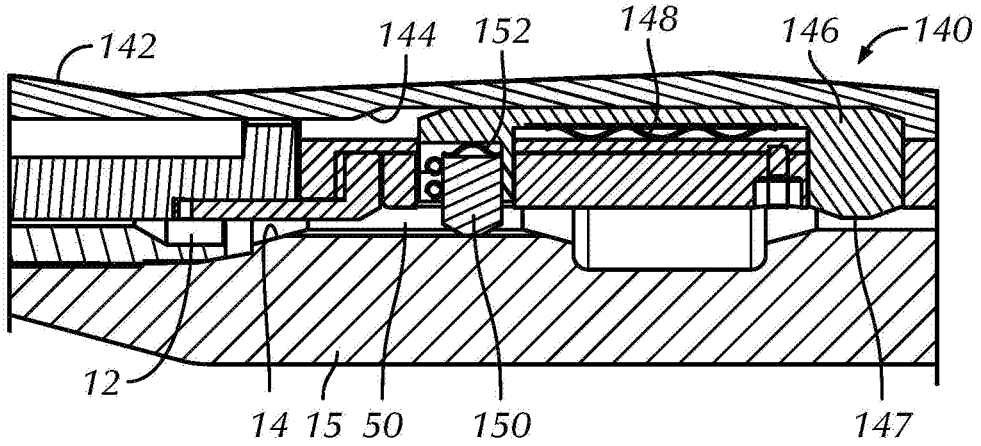
FIGS. 4A-4B illustrate detailed cross-sectional views of orientation keys of the operational tool engaged in orientation slots of the tubular.

The orientation key 150 as well as the orientation slot 50 can have a number of variations. As shown in FIG. 4A, the orientation key 150 can have a head with less of a longitudinal length than the orientation slot 50. By contrast, the orientation key 150 as shown in FIG. 4B can have a head with as great as or greater longitudinal length than the orientation slot 50.

Figure 4B:
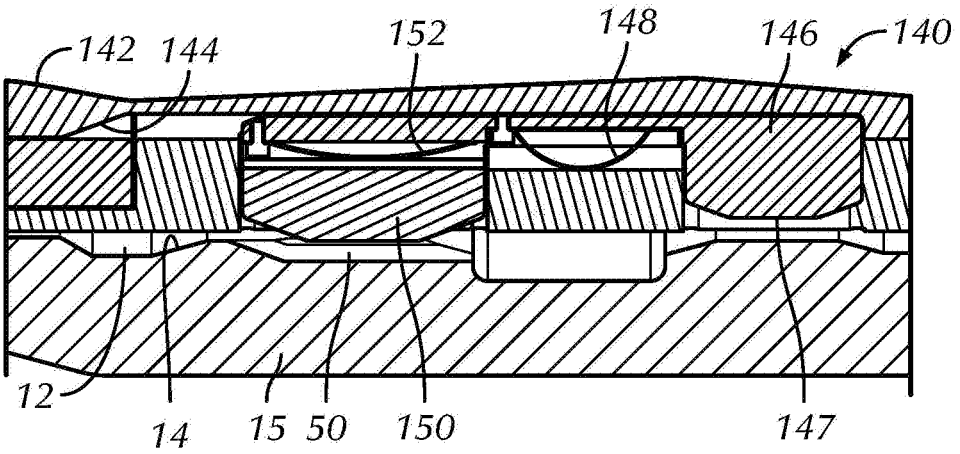

Moreover and as shown in both FIGS. 4A-4B, the orientation key 150 can be carried on a carriage 146 movably disposed and biased on an inner component 142 of the operational device 140. For example, a leaf spring 148 can push the carriage 146 toward a retracted position on the device's inner component 142. The key 150 itself may be biased to an extended condition by a leaf spring 152 on the carriage 146. The carriage 146 may include a foot or rest 147, which can engage against the sidewall of the tubular component 15 when the operational device 150 is activated to help hold its orientation in the internal bore 12 during the operation being performed. The carriage 146, for example, may be pushed outward by shifting of a shoulder 144 on the inner component 142 against the carriage 146. Such an arrangement is suitable when axial movement noted previously is used for actuating a mechanical form of the operation.

For its part, the orientation slot 50 can include some variations. As shown in FIG. 4A, the orientation slot 50 can be defined as a uniform channel passing through the nipple 14 in the internal bore 12 from the uphole edge to the downhole edge. As noted, this can allow for debris flush out of the slot 50. By contrast, the orientation slot 50 as shown in FIG. 4B can be defined at a deeper depth in at least a portion of the nipple 14 than presented in FIG. 4A. In fact, the slot 50 can have a lead end dip, which can act as an engagement shoulder at the uphole edge of the nipple 14 against the orientation key 150 when engaged therein. This engagement may help settle the operational component 140 in position when aligned for the operation to be performed.

Even with this end dip, the slot 50 is essentially open along its length through the nipple 14 to enable debris to be flushed out of the slot 50.

Figure 5A:
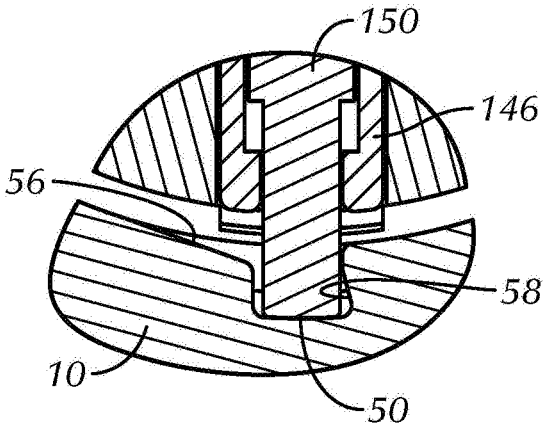
FIGS. 5A-5B illustrate detailed end-sectional views of orientation keys of the operation tool engaged in orientation slots of the tubular.
Figure 5B:
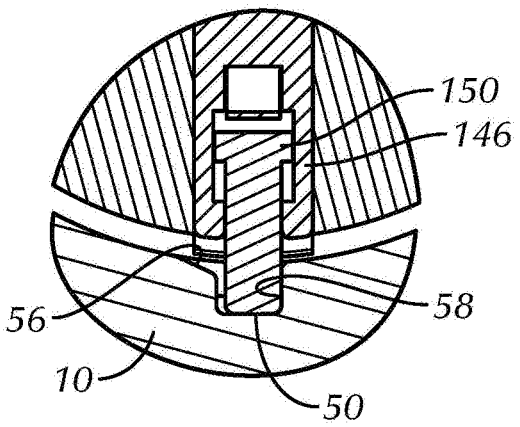

Other aspects of the orientation slot 50 can be varied. As shown in FIG. 5A and noted previously, the backwall 58 of the slot 50 can be angled to allow for a positive stop even though grit or debris may be present. This is not strictly necessary as shown in FIG. 5B, where the backwall 58 is not angled.

Instead of relying on a mule shoe sleeve disposed downhole, the disclosed apparatus includes orientation features (including the key 150 and slot 50 and including the rotation drive 106 of splines, grooves, torsion springs, a combination of spring-loaded castle J-slot style mechanisms, and the like) to deliver the energy to rotate the tool 100 by weight and orient inside the tubular 10. The orientation features force the lower portion 104 of the tool 100 to rotate and search for the orientation slot 50 with the spring-loaded finger, fin, or pin orientation 150 to stop at the correct orientation. After orienting, a variety of operations can be performed with the operational tool 100, such as punching communication with a port of a tubing retrievable safety valve. Unlike a conventional mule shoe sleeve, the orientation slot 50 of the disclosed apparatus is defined into a part of the tubular 10 that is deployed downhole. No additional parts, such as an additional mule shoe sleeve, are required.

Figure 6B:
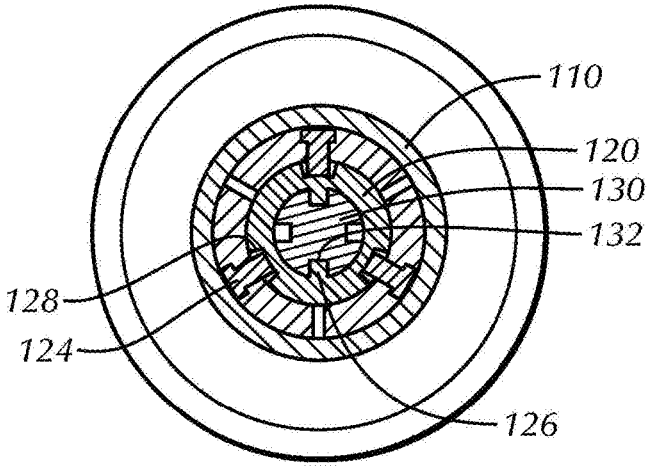
FIG. 6B illustrates an end-sectional view of the rotational drive for the operational tool of FIG. 6A.
Figure 6A:
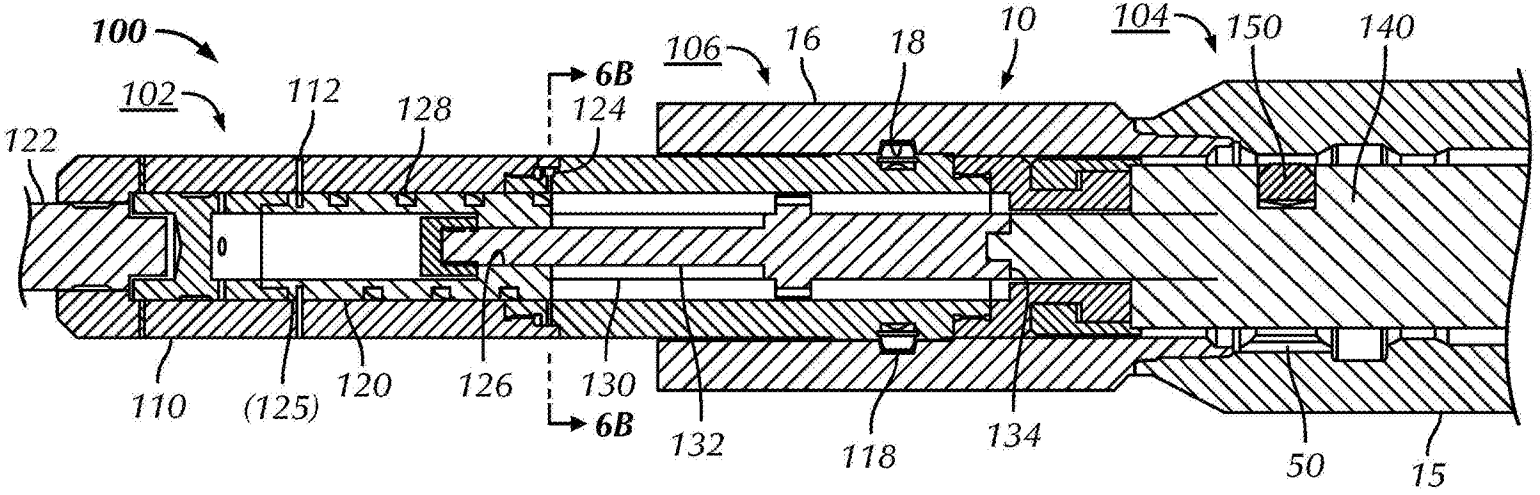
FIG. 6A illustrates a cross-sectional view of an operational tool having another rotational drive.

As noted above, other rotational drives can be used for the tool 100. As shown in FIGS. 6A-6B, another tool 100 according to the present disclosure includes a rotational drive 106 between the first and second portions 102, 104. Similar to the previous arrangement, the rotational drive 106 includes a sleeve 120 movable in the longitudinal direction in a housing 110 of the first portion 102. Similar components to other embodiments are provided with similar reference numbers, and details are not repeated here.

Instead of a groove in the housing 110 and tooth on the sleeve 120, the arrangement in FIGS. 6A-6B uses an opposite configuration. In particular, the sleeve 120 has at least one external spiral groove 128 disposed thereabout and has at least one internal tooth 126. The at least one external spiral groove 128 is engaged with at least one external tooth 124 disposed in the housing 110. As shown in the end-section of FIG. 6B, for example, three external spiral grooves 128 may be provided and may be engaged by three external teeth 124, which may be shear pins.

As before, an inner rod 130 in FIG. 6A coupled to the operational component 140 of the tool 100 has at least one longitudinal spline 132 engaged with the at least one internal tooth 126 of the sleeve 120. The inner rod 130 is rotated with the sleeve 120 in the rotational direction R as the sleeve's groove 128 slides on the housing's tooth 124.

Figure 7:
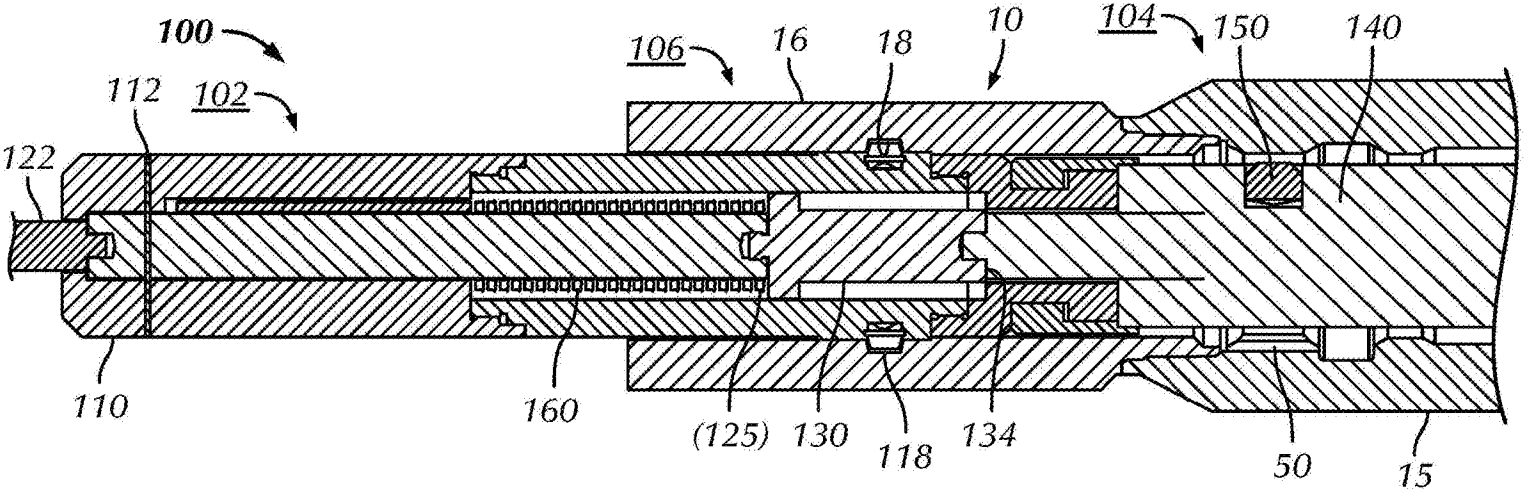
FIG. 7 illustrates a cross-sectional view of an operational tool having yet another rotational drive.

As shown in another alternative of FIG. 7, another tool 100 according to the present disclosure includes a rotational drive 106 between the first and second portions 102, 104. Similar components to other embodiments are provided with similar reference numbers, and details are not repeated here.

The rotational drive 106 includes an inner rod 130 coupled to the operational component 140 as before. A spring 160 is coupled between the tool's housing 110 and the inner rod 130 and is held in torsion. Breaking of a shear pin, such as 112, can release the held spring 160. Once released, the torsional spring 160 rotates the inner rod 130 in the rotational direction R about the longitudinal axis to turn the operation component 140 until the orientation key 150 engages the orientation slot 50.

As will be appreciated, in addition to the spline and grooves arrangements, the torsion spring arrangement discussed previous, the rotational drive can used other mechanism, such as a combination of a spring-loaded castle, J-slot style mechanism.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for performing an aligned operation downhole, the assembly comprising:

a tubular for downhole defining an internal bore with a first inner radius, the tubular having a target at a first radial orientation, the internal bore defining a locator profile thereabout at a first location and defining an internal nipple thereabout at a second location, the internal nipple having a second inner radius less than the first inner radius of the internal bore, the internal nipple at least partially defining an orientation slot longitudinally therethrough and disposed at a second radial orientation configured relative to the first radial orientation of the target, the orientation slot comprising a channel defined through the nipple, the channel having: a face inset at a depth into the internal nipple, a lead sidewall extending in a radial direction on a lead edge of the face, and a back sidewall extending in the radial direction on a back edge of the face; and a tool deployable in a longitudinal direction into the internal bore of the tubular and having first and second portions, the first portion having a locator biased outward to engage in the locator profile of the tubular, the second portion rotatable relative to the first portion and having an operational component to perform the aligned operation at the first radial orientation of the target, the second portion having an orientor biased outward to engage in the orientation slot of the tubular.

2. The assembly of claim 1, wherein the tubular comprises a plurality of tubular components coupled together.

3. The assembly of claim 2, wherein a first of the tubular components defines the locator profile therein, and wherein a second of the tubular components defines the orientation slot.

4. The assembly of claim 3, wherein the second tubular component comprises the target at the first radial orientation.

5. The assembly of claim 2, wherein one of the tubular components comprises a safety valve housing defining the orientation slot, the safety valve housing having a hydraulic passage therein as the target at the first radial orientation.

6. The assembly of claim 1, wherein the second inner radius of the internal nipple defines a taper adjacent the orientation slot increasing a lead-in of the second inner radius in a radial direction inward toward the orientation slot.

7. The assembly of claim 1, wherein the back sidewall defines an acute angle relative to the face.

8. The assembly of claim 1, wherein the channel comprises an open end disposed at a downhole edge of the internal nipple.

9. The assembly of claim 8, wherein the channel further comprises another open end disposed at an uphole edge of the internal nipple.

10. The assembly of claim 1, wherein the tool comprises a rotational drive disposed between the first and second portions of the tool and imparting rotational movement to the second portion in a rotational direction in the internal bore, the orientor rotatable with the second portion and biased outward to engage in the orientation slot, the second portion with the orientor engaged in the orientation slot aligning the operational component for the aligned operation at the first radial orientation of the target.

11. The assembly of claim 10, wherein the locator comprises a plurality of keys disposed on the first portion and biased outward from a retracted condition to an extended condition.

12. The assembly of claim 10, wherein the rotational drive comprises:

a sleeve movable in the longitudinal direction in a housing of the first portion and having at least one external tooth and at least one internal tooth, the at least one external tooth engaged with at least one spiral groove defined in the housing; and an inner rod coupled to the second portion and having at least one longitudinal spline engaged with the at least one internal tooth of the sleeve, the inner rod rotatable with the sleeve in the radial direction about the longitudinal axis.

13. The assembly of claim 10, wherein the rotational drive comprises:

a sleeve movable in the longitudinal direction in a housing of the first portion and having at least one external spiral groove and at least one internal tooth, the at least one external spiral groove engaged with at least one tooth in the housing; and an inner rod coupled to the second portion and having at least one longitudinal spline engaged with the at least one internal tooth of the sleeve, the inner rod rotatable with the sleeve in the radial direction about the longitudinal axis.

14. The assembly of claim 10, wherein the rotational drive comprises:

an inner rod coupled to the second portion; and a spring coupled between the first portion and the inner rod and held in torsion, the spring rotating the inner rod in the radial direction about the longitudinal axis.

15. The assembly of claim 1, wherein the orientor comprises a key extending longitudinally along the second portion and biased laterally outward from a retracted condition to an extended condition.

16. The assembly of claim 1, wherein the second portion comprises an internal member having a carriage disposed externally thereon, the carriage biased toward a retracted state on the internal member, the carriage having the orientor disposed thereon, the orientor being biased toward an extended condition on the carriage, the internal member movable longitudinally relative to the carriage and forcing the carriage in an extended state into contact with the internal bore of the tubular.

17. An assembly for performing an aligned operation downhole, the assembly comprising:

a tubular for downhole defining an internal bore with a first inner radius, the tubular having a target at a first radial orientation, the internal bore defining a locator profile thereabout at a first location and defining an internal nipple thereabout at a second location, the internal nipple having a second inner radius less than the first inner radius of the internal bore, the internal nipple at least partially defining an orientation slot longitudinally therethrough and disposed at a second radial orientation configured relative to the first radial orientation of the target; and a tool deployable in a longitudinal direction into the internal bore of the tubular and having first and second portions, the first portion having a locator biased outward to engage in the locator profile of the tubular, the second portion rotatable relative to the first portion and having an operational component to perform the aligned operation at the first radial orientation of the target, the second portion having an orientor biased outward to engage in the orientation slot of the tubular, wherein the tool comprises a rotational drive disposed between the first and second portions of the tool and imparting rotational movement to the second portion in a rotational direction in the internal bore, the orientor rotatable with the second portion and biased outward to engage in the orientation slot, the second portion with the orientor engaged in the orientation slot aligning the operational component for the aligned operation at the first radial orientation of the target.

18. The assembly of claim 17, wherein the tubular comprises a plurality of tubular components coupled together.

19. The assembly of claim 18, wherein a first of the tubular components defines the locator profile therein, and wherein a second of the tubular components defines the orientation slot.

20. The assembly of claim 19, wherein the second tubular component comprises the target at the first radial orientation.

21. The assembly of claim 18, wherein one of the tubular components comprises a safety valve housing defining the orientation slot, the safety valve housing having a hydraulic passage therein as the target at the first radial orientation.

22. The assembly of claim 17, wherein the second inner radius of the internal nipple defines a taper adjacent the orientation slot increasing a lead-in of the second inner radius in a radial direction inward toward the orientation slot.

23. The assembly of claim 17, wherein the locator comprises a plurality of keys disposed on the first portion and biased outward from a retracted condition to an extended condition.

24. The assembly of claim 17, wherein the rotational drive comprises:

a sleeve movable in the longitudinal direction in a housing of the first portion and having at least one external tooth and at least one internal tooth, the at least one external tooth engaged with at least one spiral groove defined in the housing; and an inner rod coupled to the second portion and having at least one longitudinal spline engaged with the at least one internal tooth of the sleeve, the inner rod rotatable with the sleeve in the radial direction about the longitudinal axis.

25. The assembly of claim 17, wherein the rotational drive comprises:

a sleeve movable in the longitudinal direction in a housing of the first portion and having at least one external spiral groove and at least one internal tooth, the at least one external spiral groove engaged with at least one tooth in the housing; and an inner rod coupled to the second portion and having at least one longitudinal spline engaged with the at least one internal tooth of the sleeve, the inner rod rotatable with the sleeve in the radial direction about the longitudinal axis.

26. The assembly of claim 17, wherein the rotational drive comprises:

an inner rod coupled to the second portion; and a spring coupled between the first portion and the inner rod and held in torsion, the spring rotating the inner rod in the radial direction about the longitudinal axis.

27. The assembly of claim 17, wherein the orientor comprises a key extending longitudinally along the second portion and biased laterally outward from a retracted condition to an extended condition.

28. The assembly of claim 17, wherein the second portion comprises an internal member having a carriage disposed externally thereon, the carriage biased toward a retracted state on the internal member, the carriage having the orientor disposed thereon, the orientor being biased toward an extended condition on the carriage, the internal member movable longitudinally relative to the carriage and forcing the carriage in an extended state into contact with the internal bore of the tubular.

* * * * *